US006826885B2

(12) United States Patent
Raskin et al.

(10) Patent No.: US 6,826,885 B2
(45) Date of Patent: Dec. 7, 2004

(54) SYSTEM FOR REINFORCING EXTRUDED BEAMS

(76) Inventors: Stephen S. Raskin, 8549 Surrey La., Boca Raton, FL (US) 33496; William Wallace, 1026 Palma Way, Lantana, FL (US) 33462

( * ) Notice: Subject to any disclaimer, the term of this patent is extended or adjusted under 35 U.S.C. 154(b) by 0 days.

(21) Appl. No.: 10/068,589

(22) Filed: Feb. 6, 2002

(65) Prior Publication Data

US 2003/0145555 A1 Aug. 7, 2003

(51) Int. Cl.[7] ..... E04C 3/30

(52) U.S. Cl. ..... 52/731.2; 52/730.4; 52/737.1; 52/737.6; 403/393; 403/394

(58) Field of Search ..... 52/731.2, 731.3, 52/732.2, 730.4, 730.5, 732.1, 243, 241, 656.1, 656.2, 656.3, 737.1, 737.6, DIG. 8; 403/384, 393, 394

(56) References Cited

U.S. PATENT DOCUMENTS 2,990,922 A * 7/1961 Rudsill
3,070,197 A 12/1962 Musselman
3,345,794 A 10/1967 Proud
3,382,639 A * 5/1968 Smith et al.
3,420,032 A * 1/1969 Felt
3,601,946 A * 8/1971 Rothemund ..... 52/731
4,122,647 A * 10/1978 Kovar ..... 52/695
4,563,377 A * 1/1986 Melli ..... 428/36
4,640,314 A * 2/1987 Mock ..... 138/162
4,905,442 A * 3/1990 Daniels ..... 52/588.1
4,944,545 A 7/1990 Simme
5,134,250 A * 7/1992 Caveney et al. ..... 174/101
5,442,885 A * 8/1995 Laven et al. ..... 52/731.3
5,471,809 A 12/1995 Frankel
5,570,548 A * 11/1996 Hopper ..... 52/204.5
5,657,606 A * 8/1997 Ressel et al. ..... 52/690
5,660,119 A * 8/1997 Perkins ..... 108/51.3
5,729,950 A * 3/1998 Hardy ..... 52/693
5,758,456 A 6/1998 Case
5,833,181 A * 11/1998 DesNoyers ..... 248/156
5,921,053 A 7/1999 Callahan
5,942,729 A * 8/1999 Carlson et al. ..... 174/68.1
6,385,941 B1 * 5/2002 Power et al. ..... 52/731.3
6,389,778 B1 * 5/2002 Strange ..... 52/745.19
6,601,362 B1 * 8/2003 Prince ..... 52/732.1
6,668,495 B1 * 12/2003 Prince ..... 52/63

* cited by examiner

*Primary Examiner*—Carl D. Friedman
*Assistant Examiner*—Yvonne M. Horton
(74) *Attorney, Agent, or Firm*—Kevin P. Crosby, Esq.; Daniel C. Crilly, Esq.; Brinkley, McNerney, et al.

(57) ABSTRACT

The present invention relates to new and unique designs that improve and enhance the section properties of load bearing structural members, which have particular, but not exclusive, application in connection with aluminum extrusions for use in screened pool, patio and porch enclosures. The invention utilizes one or more reinforcing inserts or slats which attach to a structural member such as a hollow extruded beam to increase the effective wall thickness of the beam in the area where the slat is applied.

20 Claims, 6 Drawing Sheets

34
38

30
36
32

50
50
34
32

30
50

SYSTEM FOR REINFORCING EXTRUDED BEAMS

BACKGROUND OF THE INVENTION

1. Field of the Invention

This invention relates to load bearing structural members and, more particularly, relates to systems and methods for increasing the section properties of structural beams as and where needed depending upon expected load conditions.

2. Background Information

Aluminum framing components, such as those used in the construction of pool, patio and porch enclosures, consist generally of hollow aluminum extrusions and open back extrusions, which are fastened together and may be used separately or in a system. The hollow extrusions used today have top and bottom walls and two sidewalls. In one environment, they are used in screen enclosures as beams, purlins, rails, uprights and the like. Generally, the larger the area of the enclosure, the bigger, stronger and heavier the extrusions must be in order to meet the design and structural loads and wind pressure resistance standards required by building codes. The new building codes require aluminum enclosures to be built to withstand higher wind speeds than ever before and significantly higher design pressures and structural loads than in the past. The result is an enclosure that must consist of heavier and larger beam members to meet the same span and height criteria than was previously necessary under prior building codes.

The following U.S. Patents disclose attempts at reinforcing structural members:

| U.S. Pat. No. | Issued | To | Entitled |
|---|---|---|---|
| 5,758,456 | Jun. 2, 1998 | Case | DECK PLANK |
| 4,944,545 | Jul. 31, 1990 | Simme | STANCHION FOR GOODS VEHICLES |
| 3,345,794 | Oct. 10, 1967 | Proud | CONSTRUCTION AND ERECTION OF FRAMING MEMBERS |
| 5,921,053 | Jul. 13, 1999 | Callahan | INTERNALLY REINFORCED GIRDER WITH PIERCEABLE NONMETAL COMPONENTS |
| 5,471,809 | Dec. 5, 1995 | Frankel | REINFORCED PLASTIC STRUCTURAL SUPPORT MEMBER |
| 3,070,197 | Dec. 25, 1962 | Musselman | METALLIC DOOR CONSTRUCTION |

However, none of the systems disclosed in any of these patents efficiently and inexpensively reinforce load bearing structural members in a manner that permits the selective reinforcement of portions or all of particular structural members as needed, where needed. It is as a result of this serious shortcoming in the field of reinforced structural members that the present invention is being proposed.

SUMMARY OF THE INVENTION

Terms used herein such as "structural member" and "beam" are intended to encompass any element capable of sustaining loading forces such as those brought about by gravity, wind and other forces.

In the case of extruded aluminum beams and the like, one or more interior or exterior surfaces of the hollow extrusion have one or more extruded rails to allow for a continuous dovetail-like connection with one or more corresponding elongated slots defined by the slat.

The "slats" or "inserts" are placed at either or both the top and/or bottom wall(s) of a beam or column, in various lengths and interlocked, if desirable, to each other to allow for variable increase in strength as needed. This method allows for site-specific design without compromise of architectural appearance.

In addition to the reinforcing insert, wind brace beams with an internal truss-like support and connections have been designed to provide a three-dimensional interlocking frame that allows for increased spans for existing beam sizes. This system offers stability not presently realized in today's enclosures. The wind brace beams are stronger than any other current extrusion its size, is more aero-dynamic, will hold less debris, are visibly less obtrusive due to their smaller size, and, in the case of screen enclosure applications, are able to be placed on the inside of a screen roof affording greater safety during installation and providing a structural benefit not realized in current designs.

The inventions' advantages are many. Use of the system will allow screen enclosures to be built with longer spans and taller walls using smaller dimension extrusions and still meet current code requirements.

In many cases screen enclosures will be able to match existing visible design criteria in addition to being able to match existing size extrusions for repair purposes and still meet the more stringent code requirements. It is also more aesthetically pleasing due to the use of smaller and lighter extrusions.

The system, while using smaller extrusions to meet code requirements, provides for easier fabrication and installation. The extrusion sizes remain manageable for safety of installation The system is more cost effective than the widely accepted method of increasing beam sizes and weights to meet code requirements. Further, smaller extrusions mean less labor costs for installation.

The system provides for the use of lighter and smaller beams for code compliance. Consequently, the stress on an existing fascia is less thus allowing for older construction to still comply with new code requirements.

It is, therefore, a principal object of this invention to provide a system and apparatus for reinforcing load bearing structural members.

It is also an object of this invention to provide a system and method for reinforcing extruded structural members in such a manner that reinforcement can be applied on an as-needed, where-needed, basis to optimize the amount of reinforcement material used.

It is an even further object of this invention to provide a structural member, which is light in weight and easy to reinforce.

It is another object of this invention to provide structural members which can be reinforced on an as-needed basis based upon expected loading conditions and assembled into an architectural structure.

It is a further advantage of this invention to provide a system for reinforcing structural members where the application of the reinforcing members is limited to the area where increased load resistance is needed, saving the expense of over strengthening areas where fortification of the existing structural member is unnecessary.

It is a still further object of this invention to provide a method for reinforcing structural members used to create an architectural structure, including the steps of: providing an extruded hollow beam, preferably made of metal, which beam has at least one reinforcement slat connecting rail or lug integrally connected thereto; providing a reinforcing insert, also preferably made of metal, which has an elongated channel therein adapted to mate in inter-fitting engagement with the connecting rail or lug; slidably placing the reinforcing insert upon the rail or lug, the reinforcing insert being sized and positioned relative to the beam in accordance with engineering calculations which determine the expected distribution of forces along the beam; and assembling a plurality of such beams into an architectural structure.

These and other objects will be apparent to those skilled in the art when viewed in connection with the following description of the invention.

BRIEF DESCRIPTION OF THE DRAWINGS

FIG. 3 is a partial cutaway, partially exploded, perspective view of an embodiment of the invention in use in connection with patio or pool screen enclosure structural beams.

DETAILED DESCRIPTION OF THE PREFERRED EMBODIMENTS

Figure 1:
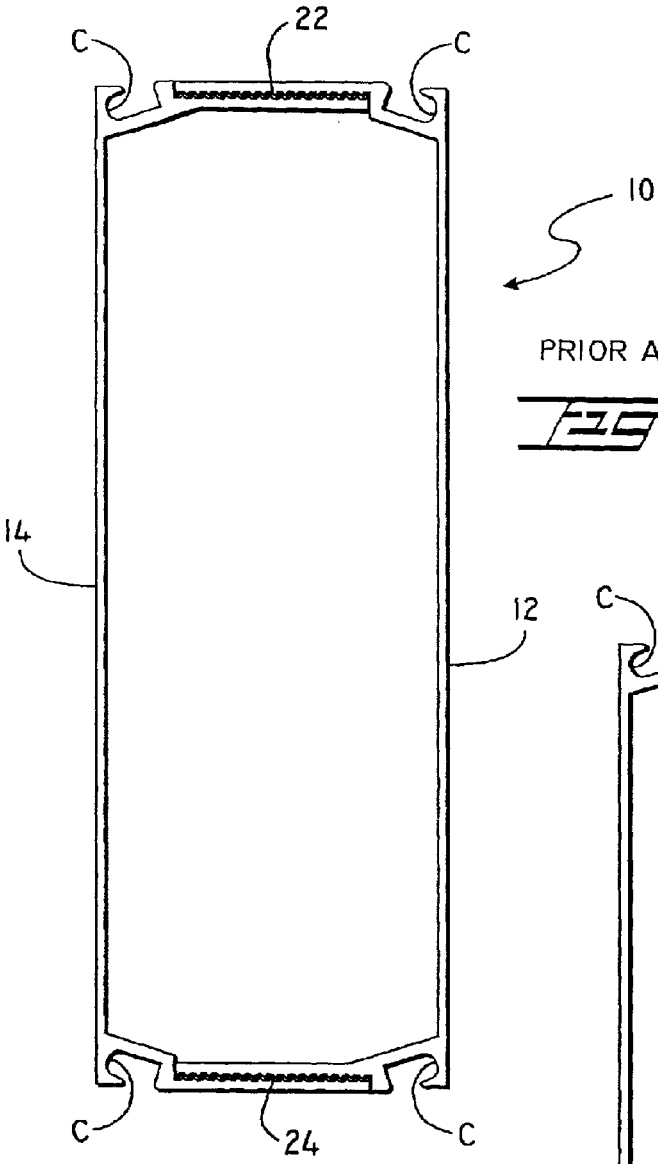
PRIOR ART FIG. 1
FIG. 1 is a front elevational view of an extruded beam known in the art.

Extruded beams, such as those used for supporting screening material around patios, pools, porches, etc, are well known in the art and have been manufactured in a wide variety of shapes. An example of one such beam is shown in FIG. 1. The beam 10 is constructed of a pair of "c" shaped halves 12 and 14, and are connected along respective upper and lower serrated interfaces 22, 24. Such beams 10 are provided in whatever length is appropriate to the design of the structure. Beam halves 12 and 14 can be connected by any conventional means, such as by use of a sheet metal screw, rivet, or other fastener (not shown). Channels C are provided, which are used to receive the beaded edge (not shown) of a section of screen.

Such beams, being structural members of a screen enclosure, are subject to forces brought on by gravity, wind, loads and the like. With the ever increasing size of today's screen enclosures and other structures which utilize similar structural members, and with the increasingly stringent building code specifications for such members, it is desirable to provide an apparatus, system and method for inexpensively and efficiently reinforcing such beams but only in the areas where reinforcement is called for.

Figure 2B:
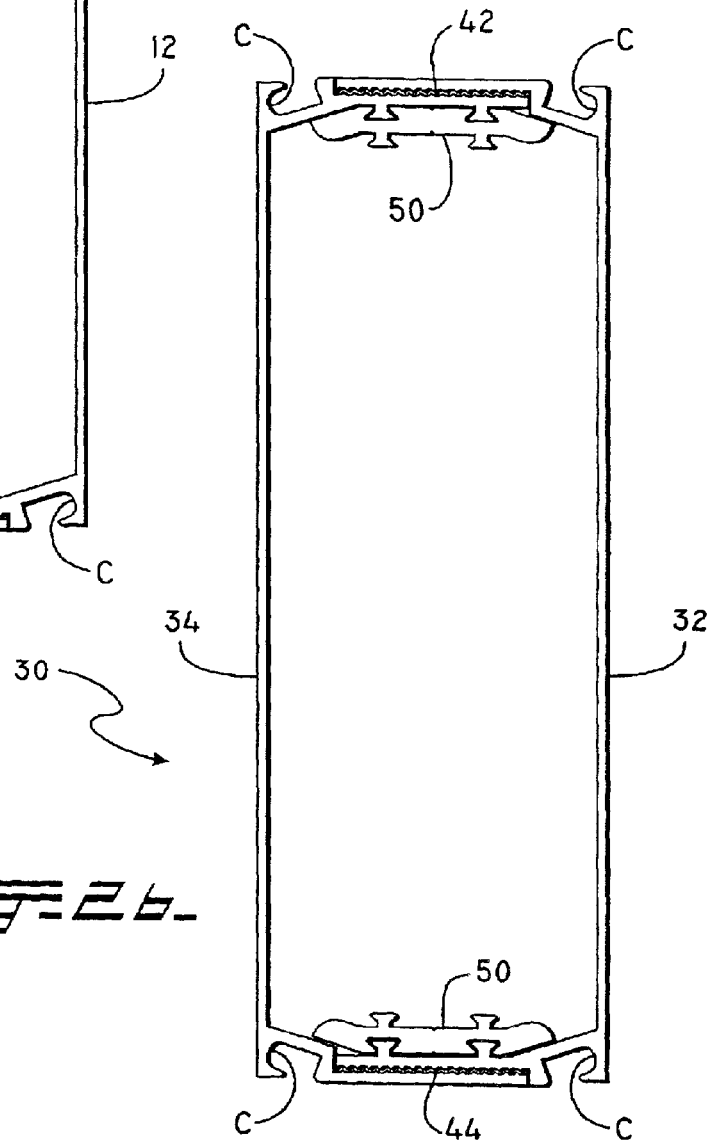
FIG. 2B is an assembled front elevational view of a modified embodiment of the invention.
Figure 2A:
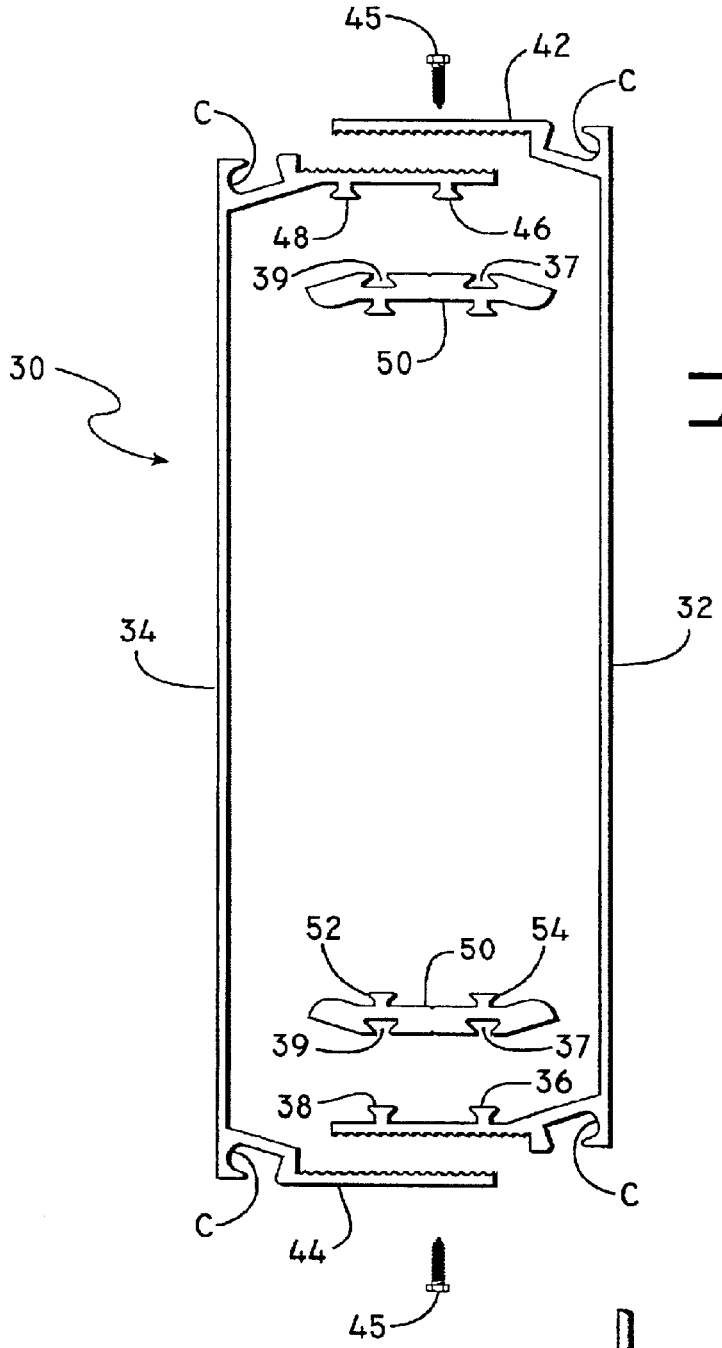
FIG. 2A is an exploded front elevational view of a re-enforced beam in accordance with one embodiment of this invention.

Referring now to FIGS. 2A and 2B, there is disclosed a modified beam 30 in accordance with the instant invention. Beam 30, like beam 10 of FIG. 1, is comprised of a pair of halves 32, 34, which meet along serrated interfaces 42, 44, and which can be fastened together using any suitable means. Channels C are provided for the reasons specified in connection with FIG. 1. The improvement provided by this invention is found in the use of reinforcing inserts 50, which are connected to an interior surface of beam 30. In FIG. 2B, upper and lower inserts 50 are utilized, although one or the other can be deleted, and/or additional inserts 50 can be added on top of those shown.

Figure 2C:
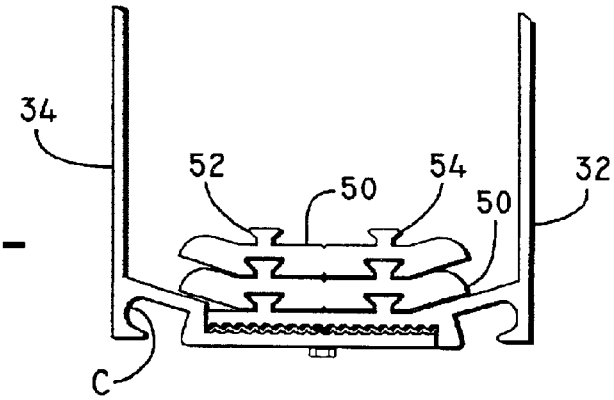
FIG. 2C is a front elevational view of a still further modified embodiment of this invention.

In FIG. 2C, two inserts 50 are shown connected to the interior of beam half 32. It can therefore be seen that any number of inserts 50 may be utilized, either near the bottom or the top, or both, of beam 30.

Inserts 50 are connected to beam 30 by any suitable means. For purposes of illustration but not by way of limitation, elongated rails 36, 38 are integrally formed with beam halves 32 and 34, which are adapted to mate in inter-fitting engagement with corresponding grooves 37, 39 defined by reinforcing inserts 50.

Inserts 50 are slidably disposed upon rails 36, 38 connected to beam right half 32, and/or upon rails 46, 48 which are integrally connected to left beam half 34.

To reinforce a beam utilizing the invention, one calculates, for example by the use of finite element analysis, the expected loading on the structure made up of beams 30, and determines where reinforcement is necessary, and the amount of reinforcement needed. Thereafter, either at the factory or at the construction site inserts 50 are slid along rails 36, 38 and/or 46, 48. The amount of reinforcement needed, and the areas where reinforcement is needed, dictate the number and length of the reinforcing inserts 50 which are attached to the beams 30. Inserts 50 can be provided in any length whatsoever, depending upon the strengthening parameters called for in a particular situation.

It is to be understood that the circumstances of a particular construction may call for reinforcing inserts 50 to be provided along the sidewalls of the beam as opposed to the top and bottom walls thereof. Still further, the reinforcing inserts may be attachable to the beam along exterior surfaces as opposed to the interior surface embodiment shown in the drawings.

In addition, the particular connection structure, i.e., dove tail connection, shown in the drawings is not intended to limit the scope of the invention, but is shown only by way of example. Other types of connection are contemplated to be within the scope of the invention, such as differently shaped rails or discontinuous rails in the form of independently applied projections aligned with one another so that reinforcing inserts may be slid there over.

By using the invention, it is now possible to design variable composite beams to permit the strengthening of the section properties of such beams where, and only where needed. In this way, material costs are greatly reduced, and the precise stiffening of the overall structure can be accomplished.

Figures 4, 5, 6:
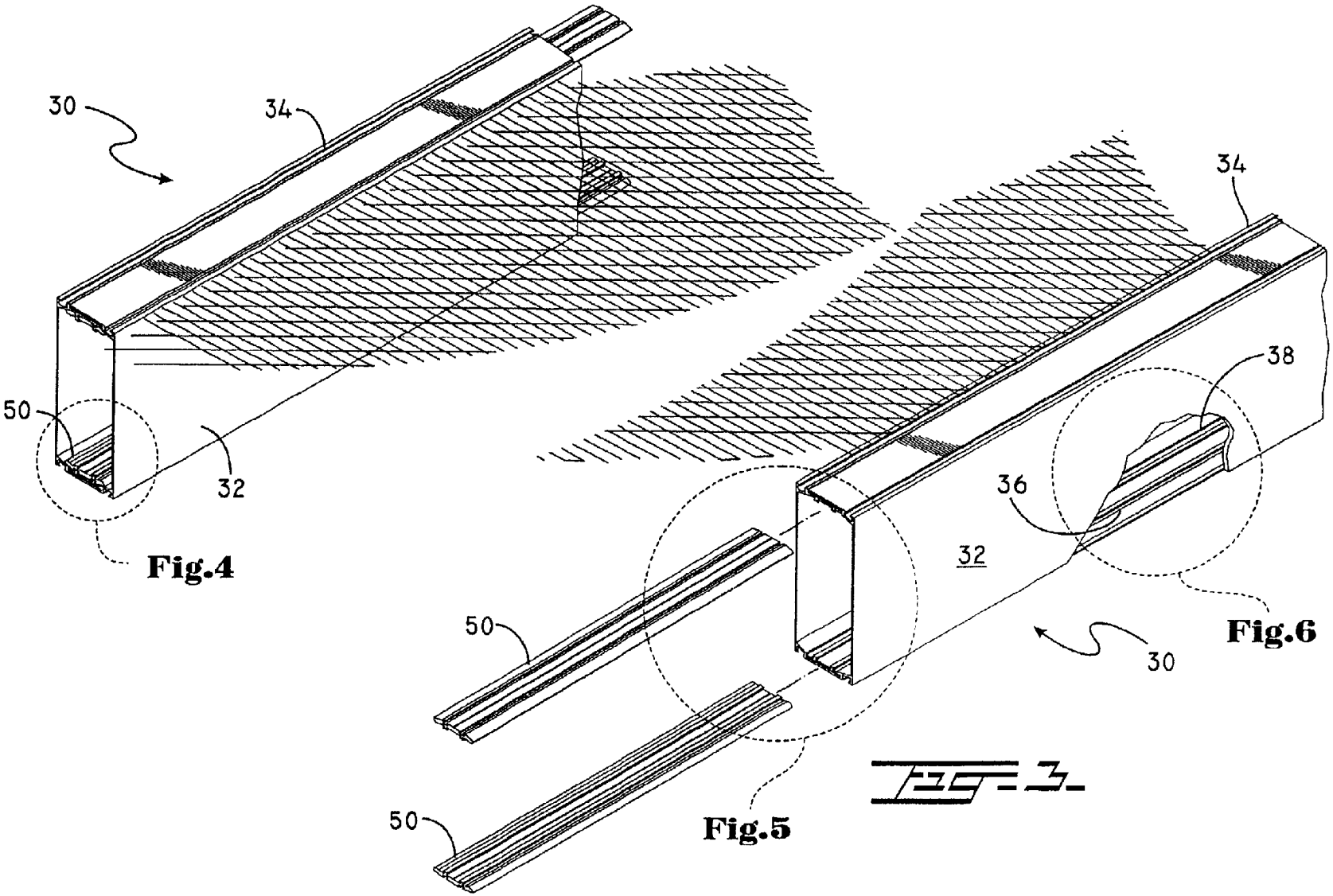
FIG. 4 is an enlargement of the area of detail shown in FIG. 3.
FIG. 5 is an enlarged view of the area of detail shown in FIG. 3.
FIG. 6 is an enlargement of the area of detail shown in FIG. 3.
Figure 4:
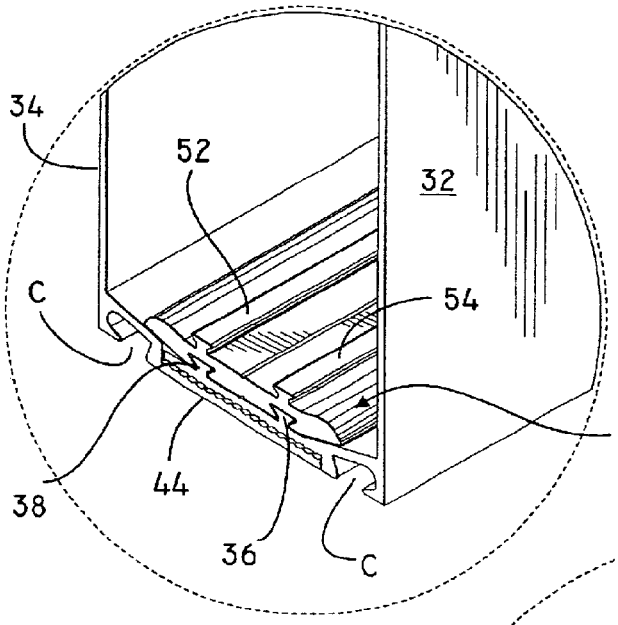
Figure 5:
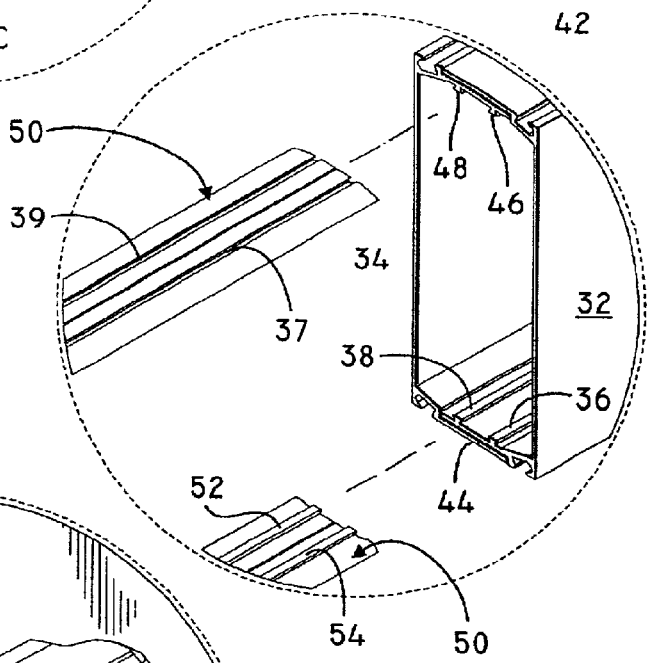
Figure 6:
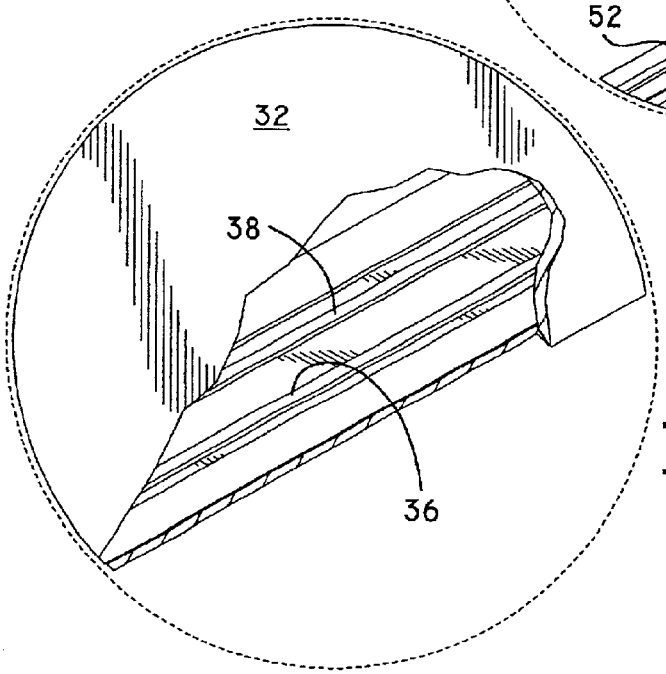

FIGS. 4 through 6 show inserts 50 in place or about to be installed within beams 30 and a section of screen S installed there between.

Figure 7B:
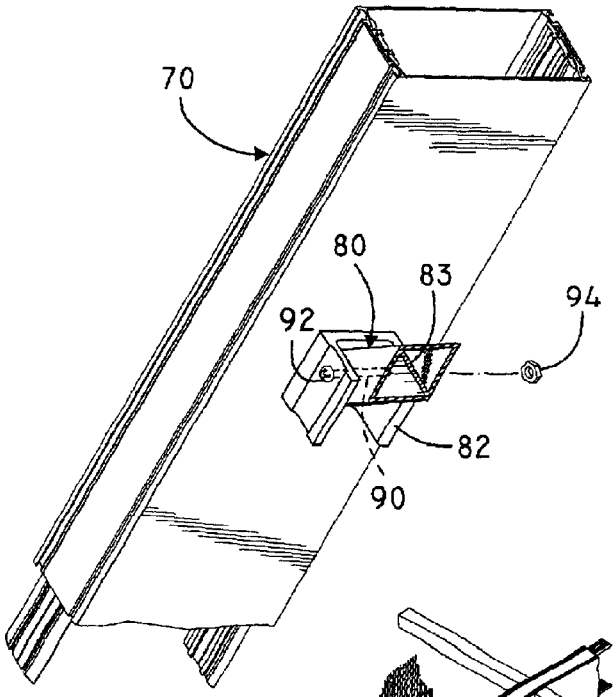
FIG. 7*b* illustrates a coupling system for attaching a novel transverse brace between structural members.
Figure 7A:
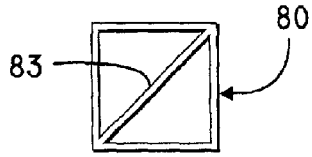
FIG. 7*a* is a front elevational view of a novel brace.
Figure 8:
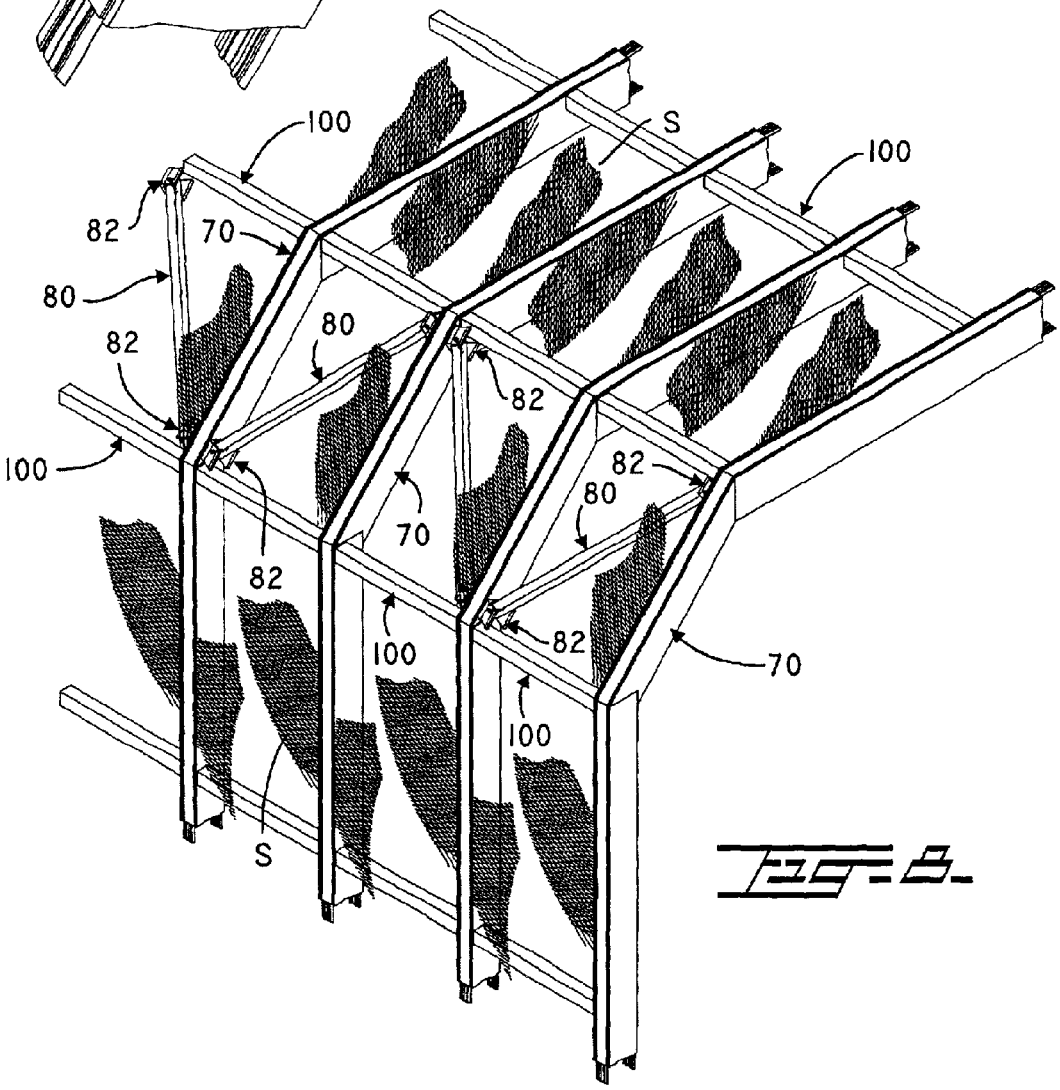
FIG. 8 is a perspective view of a portion of a structure in accordance with the invention showing a novel strengthening brace being employed.

Referring now to FIGS. 7 and 8, there is shown a further strengthening feature for structures of the type to which the invention is directed, in the form of a wind brace 80 adapted to be connected transversely between adjacent structural members 70. Structural members 70 may or may not be beams similar to the beams 10 or 30 shown in FIGS. 1-6. Brace 80 is an extruded, elongated, member, which may be square or any other cross sectional configuration, and has an inner diagonal web 83 integrally formed therewith to provide added strength. Brace 80 can be connected between adjacent structural members 70 using U-shaped brackets 82 and any suitable fastener, such as through bolt 90 having a head 92 adapted to be engaged by a tool and a corresponding connector such as threaded nut 94. Bracket 80 can be attached to beam 70 by any suitable means, such as sheet metal screws, pop rivets, etc. As will be readily apparent to those of skill in the art, the use of braces 80 in the manner shown and described herein increases the statical determinacy of an architectural structure to which it is applied.

The beams in connection with which the invention is utilized may be of any particular configuration, either one piece, two-piece, or any number of pieces making up the body of the beam. The only feature that is required is that the beam must have some means for attaching a reinforcing element thereto so as to increase the effective wall thickness, and hence the section properties, of the beam.

The invention is also directed to a method for reinforcing structural members used to create an architectural structure, including the steps of: providing an extruded hollow beam, preferably made of metal, which beam has at least one reinforcement slat connecting rail or lug integrally connected thereto; providing a reinforcing insert, also preferably made of metal, which has an elongated channel therein adapted to mate in inter-fitting engagement with the connecting rail or lug; slidably placing the reinforcing insert upon the rail or lug, the reinforcing insert being sized and positioned relative to the beam in accordance with engineering calculations which determine the expected distribution of forces along the beam; and assembling a plurality of such beams into an architectural structure.

Figure 9:
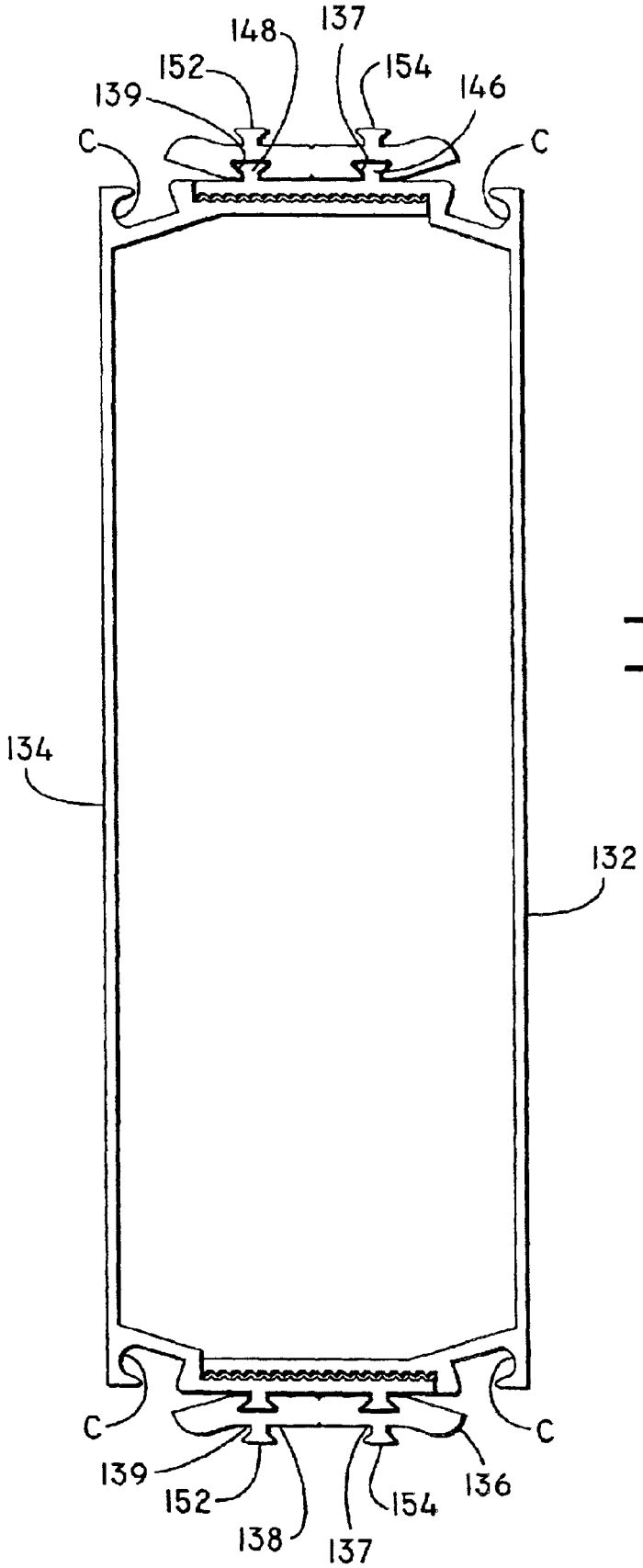
FIG. 9 is a front elevational view of a further modified embodiment of the invention.

FIG. 9 shows an alternative configuration for practicing the reinforcing insert of the invention. In this embodiment, right and left beam sections 132, 134, respectively, are provided with elongated rails 136, 138 formed integrally with each beam half 132, 134, which are adapted to mate in inter-fitting engagement with corresponding grooves 137, 139 defined by reinforcing inserts 150. As in the embodiments shown in FIGS. 2-6, additional inserts 150 can be added on top of those shown in FIG. 9.

It is to be understood that the inventions disclosed herein are not limited to the precise constructions shown and described but that changes are contemplated which will readily fall within the spirit of the invention as shall be determined by the scope of the following claims.

What is claimed is:

1. A structural member for use in forming a frame for an architectural structure, comprising:

an elongated load bearing element having a plurality of walls, each of said plurality of walls including an interior surface and an exterior surface;

at least one elongated projection fixedly connected to a central portion of said interior surface of at least one of said plurality of walls; and an elongated reinforcing insert defining at least one elongated channel that receives the at least one projection when said reinforcing insert is connected to the at least one projection, wherein the at least one projection and the at least one channel, when viewed in cross-section, flare outwardly at a common end thereof.

2. The structural member of claim 1, wherein the load bearing element has a generally rectangular cross-section.

3. The structural member of claim 1, wherein the reinforcing insert is made of metal.

4. The structural member of claim 1, wherein the reinforcing insert defines at least one secondary projection for receiving a secondary reinforcing insert.

5. A structural member for making an architectural frame, said structural member comprising:

an elongated element having a plurality of walls, each of said plurality of walls including an inner surface and an outer surface;

at least one elongated projection fixedly connected to said outer surface of at least one of said plurality of walls; and a reinforcement slat defining at least one elongated channel that receives the at least one projection when said reinforcement slat is connected to the at least one projection, wherein the at least one projection and the at least one channel, when viewed in cross-section, flare outwardly at a common end thereof.

6. The structural member of claim 5, wherein said element has a generally rectangular cross-section.

7. The structural member of claim 5, wherein the reinforcement slat is made of metal.

8. A support member for use in forming a frame for an architectural structure comprising:

a generally rectangular, hollow, elongated beam having a plurality of walls, each of said plurality of walls including an interior surface and an exterior surface;

a plurality of elongated rails integrally attached to a central region of an interior surface of at least one of the plurality of walls of the beam;

a reinforcing insert having a length coincident with or less than a length of the beam and defining a plurality of elongated channels that receive the plurality of rails when said reinforcing insert is connected to the plurality of rails, wherein each of the rails and each of the channels, when viewed in cross-section, flare outwardly at a common end thereof.

9. The support member of claim 8, wherein the beam is made of metal.

10. A method of reinforcing a support member that is used to form a frame for an architectural structure, comprising:

providing at least one elongated beam that includes a plurality of interconnected walls, at least one of the plurality of walls including at least one projecting rail integrally connected to a central region of an inside surface thereof;

providing a reinforcing insert defining at least one elongated channel adapted to mate in inter-fitting engagement with said at least one rail, wherein the at least one rail and the at least one channel, when viewed in cross-section, flare outwardly at a common end thereof; and connecting the insert to the beam by inter-fitting the at least one rail within the at least one channel, the insert being sized and positioned relative to the beam in accordance with engineering calculations which determine the expected distribution of forces along the beam.

11. The method of claim 10, further including the step of incorporating a plurality of such beams into an architectural structure.

12. The method of claim 10, wherein the reinforcing insert is made of metal.

13. An architectural structure comprising:

a pair of adjacent structural beam members, at least one of the structural beam members including:

an elongated load bearing element having a plurality of walls, each of said plurality of walls including an interior surface and an exterior surface;

at least one elongated projection fixedly connected to said interior surface of at least one of said plurality of walls; and a reinforcing insert defining at least one elongated channel that receives the at least one projection, wherein the at least one projection and the at least one channel, when viewed in cross-section, flare outwardly at a common end thereof; and a rectangular strut connected transversely between the pair of adjacent structural beam members, the strut including:

four walls defining an interior space, each wall meeting at a corner intersection, and a transverse web extending from one corner intersection to a diagonally opposite corner intersection.

14. The architectural structure of claim 13, wherein the strut is extruded.

15. The architectural structure of claim 13, wherein the strut is made of metal.

16. The structural member of claim 1, wherein the at least one projection comprises a plurality of projections, wherein the at least one channel comprises a plurality of channels, and wherein each of the plurality of projections and each of the plurality of channels, when viewed in cross-section, flare outwardly at a common end thereof.

17. The structural member of claim 5, wherein the at least one projection comprises a plurality of projections, wherein the at least one channel comprises a plurality of channels, and wherein each of the plurality of projections and each of the plurality of channels, when viewed in cross-section, flare outwardly at a common end thereof.

18. The method of claim 10, wherein the at least one rail comprises a plurality of rails, wherein the at least one channel comprises a plurality of channels, and wherein each of the plurality of rails and each of the plurality of channels, when viewed in cross-section, flare outwardly at a common end thereof.

19. A method of reinforcing a support member that is used to form a frame for an architectural structure, comprising:

providing at least one elongated beam that includes a plurality of interconnected walls, at least one of the plurality of walls including at least one projecting rail integrally connected to an inside surface thereof, the at least one elongated beam including a pair of adjacent beams;

providing a reinforcing insert defining at least one elongated channel adapted to mate in inter-fitting engagement with said at least one rail, wherein the at least one rail and the at least one channel, when viewed in cross-section, flare outwardly at a common end thereof;

connecting the insert to the beam by inter-fitting the at least one rail within the at least one channel, the insert being sized and positioned relative to the beam in accordance with engineering calculations which determine the expected distribution of forces along the beam;

providing a rectangular strut having four walls defining an interior space, each wall meeting at a corner intersection, and a transverse web extending from one corner intersection to a diagonally opposite comer intersection; and connecting the rectangular strut transversely between the pair of adjacent beams to provide structural support to the pair of adjacent beams.

20. The architectural structure of claim 13, wherein the at least one projection comprises a plurality of projections, wherein the at least one channel comprises a plurality of channels, and wherein each of the plurality of projections and each of the plurality of channels, when viewed in cross-section, flare outwardly at a common end thereof.

* * * * *